US005330808A

United States Patent [19]

Duff et al.

[11] Patent Number: 5,330,808

[45] Date of Patent: Jul. 19, 1994

[54] POLYOLEFIN BOTTLES WITH GLOSSY SURFACE

[75] Inventors: Allan W. Duff; Heinz P. Krysmanski, both of Oakville; Helga A. Plishka, Etobicoke, all of Canada

[73] Assignee: Du Pont Canada Inc., Mississauga, Canada

[21] Appl. No.: 802,179

[22] Filed: Dec. 4, 1991

[51] Int. Cl.[5] ..... B65D 23/00

[52] U.S. Cl. ..... 428/35.7; 428/421; 428/36.92; 215/1 C; 215/12.1; 525/199

[58] Field of Search ..... 428/35.7, 35.9, 36.92, 428/421, 515, 500; 215/1 C, 12.1; 525/199

[56] References Cited

U.S. PATENT DOCUMENTS 3,998,914 12/1976 Lillis et al. ..... 260/897 A
4,943,458 7/1990 Buecheler ..... 428/35.7
4,983,677 1/1991 Johnson et al. ..... 525/127

FOREIGN PATENT DOCUMENTS 2069924 2/1980 United Kingdom .

*Primary Examiner*—Charles R. Nold

[57] ABSTRACT

A bottle having a glossy surface, with a gloss of at least 50 on its external surface. The bottle has its external surface formed from a polymer selected from linear polyethylene having a density of at least about 0.940 g/cm$^3$, a melt index of less than 2.0 dg/min and a stress exponent of less than 1.5. Preferably the polymer contains at lease 400 ppm of a fluoroelastomer processing aid. A process for making bottle with a glossy surface, consisting essentially of blow moulding polymer in continuous extrusion blow moulding apparatus or injection blow moulding apparatus, using a mould with a polished surface and a shear rate of less than 10 000 sec$^{-1}$.

4 Claims, No Drawings

POLYOLEFIN BOTTLES WITH GLOSSY SURFACE

The present invention relates to polyolefin bottles having a glossy surface, and especially to such bottles that have been formed in a blow moulding process from linear, low pressure, polyethylene having a density of at least 0.940 g/cm$^3$ and a narrow molecular weight distribution.

As used herein: Melt Index is measured by the method of ASTM D-1238 (condition E); Density is measured by the method of ASTM D-1505; Stress Exponent (SEx) is a measure of the molecular weight distribution of a polymer, as is discussed in Canadian Patent 664 699, issued Jun. 11, 1963, to C. E. Ashby, S. P. Foster and E. T. Pieski, and in Canadian Patent 771 260, issued Nov. 07, 1967, to D. J. Ryan and B. J. Starkey; it is determined by measuring the throughput of a melt indexer at two stresses (2160 and 6480 g loading), using the procedures of the ASTM D-1238, and calculated using the formula:

SEx=1 log (wt. extruded with 6480 g weight)

0.477 (wt. extruded with 2160 g weight)

Gloss is measured by the procedure of ASTM D-2457.

Polyolefins are used in a wide variety of end uses. An important end use for polyolefins is in the packaging industry, including in the form of bottles for the packaging of fluids, especially aqueous fluids as polyolefins exhibit excellent resistance to permeation by water. Thus, polyolefin bottles are used for the packaging of milk, fruit juices and other aqueous liquids.

Blow moulded polyolefin bottles, especially blow moulded polyethylene bottles, are characterized by having a surface with a low or poor gloss. While the low gloss surface contributes to the opaqueness of the bottle, it also results in the bottle having a relatively poor appearance. In contrast, bottles made from some other polymers, especially polyvinyl chloride and polyethylene terephthalate, are generally characterized by a glossy appearance, and hence deemed superior for some end-uses.

Polyolefin bottles with relatively good gloss, compared with other polyolefin bottles, are known and such bottles particularly include bottles that have been blow moulded from low density polyethylene. However, bottles made from low density polyethylenes, especially those having the lower densities, suffer from other deficiencies inherent in such polyethylene e.g. low stiffness, lower heat deflection temperature than polyethylenes of higher density, high permeation rates to oxygen and carbon dioxide, low environmental stress crack resistance (ESCR) and low resistance to scuffing. The bottles typically used for the packaging of milk have surfaces with a low gloss and are opaque.

It has now been found that high density polyethylene may be blow moulded to form bottles with a glossy surface.

Accordingly, the present invention provides a bottle having a glossy surface, said bottle having its external surface formed from a polymer selected from linear polyethylene having a density of at least about 0.940 g/cm$^3$, a melt index of less than 2.0 dg/min and a stress exponent of less than 1.5, said bottle having a gloss of at least 50 on its external surface.

In a preferred embodiment of the bottle of the present invention, the bottle is a monolayer bottle.

In a further embodiment, the polyethylene contains at least 400 ppm of a fluoropolymer processing aid.

The present invention also provides a process for making a bottle with a glossy surface, comprising:

(i) feeding to apparatus selected from continuous extrusion blow moulding apparatus and injection blow moulding apparatus, a composition of a polymer selected from linear polyethylene having a density of at least about 0.940 g/cm$^3$, a melt index of less than 2.0 dg/min and a stress exponent of less than 1.5, and at least 400 ppm of a processing aid;

(ii) blow moulding said polyethylene into a mould with a polished surface using a shear rate of less than 10 000 sec$^{-1}$; and (iii) cooling the bottle so formed, said bottle having a gloss of at least 50 on its external surface.

In a preferred embodiment of the process of the present invention, the bottle is formed in a vented multi-sectioned mould having mould faces and mould parting lines where sections of the mould abut, said mould having vents along both the mould parting lines and on the mould faces.

In another embodiment, the surface of the mould face has been draw polished in a direction towards the parting line.

The polymer used in the embodiments of the invention is a high density linear polyethylene. Polyethylene may be manufactured in a number of different types of processes, including high pressure free radical processes and high pressure and especially low pressure processes that utilize coordination catalysts, the polymers of the coordination catalyst processes being known as linear polyethylene. The present invention pertains to certain of the latter polymers viz. linear polyethylene, especially linear low pressure polyethylene, having a density of at least about 0.940 g/cm$^3$. Such polyethylene may be a homopolymer of ethylene and/or a copolymer of ethylene with a minor amount of at least one $C_4$–$C_{10}$ hydrocarbon alpha-olefin. Examples of such alpha-olefins are butene-1, hexene-1, octene-1 and 4-methyl pentene-1. Although polyethylene may be produced in a wide range of densities e.g. densities in the range of about 0.915 to 0.965 g/cm$^3$; the polyethylenes to which the present invention pertains have a density of at least about 0.940 g/cm$^3$.

The polyethylene has a melt index of less than 2.0 dg/min and especially in the range of 0.2–2.0 dg/min. The melt index actually selected for the manufacture of bottles will depend in part on the size and shape of the bottle that is to be blow moulded, with the higher melt index values tending to be used in the manufacture of small bottles and lower melt index values tending to be used in the manufacture of larger bottles, as will be appreciated by persons skilled in the art.

Stress Exponent (SEx) is a measure of molecular weight distribution. Polyethylenes of broad molecular weight distribution are characterized by higher values of stress exponent and polyethylenes of narrow molecular weight distribution are characterized by lower values of stress exponent. For instance, polyethylenes having a broad molecular weight distribution typically have a stress exponent of at least about 1.7 and especially at least about 2.0. The polyethylenes used in the present invention have a narrow molecular weight distribution, characterized by a value of stress exponent (SEx) of less than 1.5, and especially less than 1.4.

In a preferred embodiment of the invention, the polymer contains a processing aid, especially a processing aid that is a fluoropolymer, including fluoroelastomers. Examples of fluoropolymer processing aids are given in Canadian Patent 655 293 and U.S. Pat. No. 3,125,547, both of P. S. Blatz, which issued Jan. 01, 1963 and Mar. 17, 1964, respectively, and are commercially available from Du Pont Canada Inc. or from E. I. du Pont de Nemours and Company of Wilmington, Del. U.S.A. under the trade mark "Viton A". In preferred embodiments, the polymer contains at least 400 ppm of such processing aid, especially at least 700 ppm and in particular at least 1000 ppm. In particularly preferred embodiments, the processing aid is Viton A fluoropolymer, or an equivalent thereof. Other fluoropolymer processing aids are disclosed by G. R. Chapman et al in U.S. Pat. Nos. 4,904,735 and 5,013,792. Fluoropolymer-containing processing aids are also disclosed in U.S. Pat. Nos. 4,740,341, 4,863,983 and 4,983,677. Bottles having a glossy surface may be blow moulded from the polymer. In particular, bottles having a surface gloss of at least 50 may be obtained. In preferred embodiments, the bottles have a gloss of at least 60 and especially at least 70.

In preferred embodiments of the invention, the bottle is a monolayer bottle i.e. the bottle is made from the polymer described herein as the only polymer used in fabrication of the bottle. However, in other less preferred embodiments, the bottle may be a multilayer bottle with the polymer described herein as the outer or external layer. Monolayer bottles are preferred, offering ease of recycling and a more economical fabrication process.

Techniques for the blow moulding of bottles from polyethylene are known. However, in the process of the present invention, the apparatus is a particular type of blow moulding apparatus viz. either a continuous extrusion blow moulding apparatus or an injection blow moulding apparatus, especially a continuous extrusion apparatus. Furthermore, the process is operated such that the shear rate is less than 10 000 $sec^{-1}$, especially at a shear rate of less than 2000 $sec^{-1}$ and in particular less than 1000 $sec^{-1}$. The blow moulding of the polymer under conditions that include such low shear rates is believed to be an important aspect of the operation of the blow moulding process.

The mould used in the blow moulding process is a multi-sectioned vented mould. Moulds used in blow moulding processes as usually formed in two parts or halves which when together form the mould but which may be moved apart to facilitate removal of the moulded article. The parts of the mould meet along a so-called parting line i.e. the line where the parts of the mould abut when the mould is in a closed condition. Moulds used in the blow moulding of polyolefins usually have vents at the parting lines. It is preferred that the moulds used in the process of the present invention also have vents spaced away from the parting lines i.e. at what are often referred to as the face sections of the mould. The moulds used in the process have a polished surface, in contrast to moulds with sand-blasted surfaces that are typically used in the blow moulding of polypropylene and polyethylene. For instance, the moulds used in the process of the invention have a SPI-SPE mould finish number of 3 or less, whereas moulds typically used in the blow moulding of polyethylene or polypropylene have a SPI-SPE mould finish number of at least 5. In a preferred embodiment, the surface has been draw polished in a direction towards a parting line, to facilitate escape of gases during the moulding process.

The bottles of the present invention have a variety of uses, including uses known for polyethylene bottles but also including uses that are particularly related to packaging in bottles requiring glossy surfaces. Thus, in at least some instances, the bottles of the invention may be used instead of bottles fabricated from polyvinyl chloride, which has heretofore not been commercially acceptable even though polyethylene offers cost advantages over polyvinyl chloride. In particular, the bottles will find use in the personal care market e.g. in the packaging of shampoo and conditioners. Moreover, polyethylene is considered to be more compatible with processes for the recycling of plastic products than is, for example, polyvinyl chloride. In addition, in the processing of the polymer composition into bottles of the invention, it is not necessary to use a so-called "starter concentrate" i.e. a concentrate used at the beginning of a run of bottles after the apparatus has been used in the processing of another polymer composition, as is the case with some other compositions for the manufacture of bottles.

The present invention is illustrated by the following embodiments of the invention:

EXAMPLE I

A number of polymer compositions were blow moulded on a Heins PCM continuous extrusion blow moulding apparatus, Model #CM2000S. The apparatus was equipped with a single blow moulding station. The mould was a highly polished tear drop-shaped detergent bottle mould. The mould had six slot or pin vents located on the mould face plus the usual vents located on the parting line of the mould.

Some of the polymer compositions contained a processing aid, which was Viton "A" processing aid, described above.

The polymer compositions were blow moulded using melt temperatures of 180°-185° C. and a cycle time of 8-12 seconds. The shear rate was calculated to be less than 200 $sec^{-1}$ in all runs, and less than 100 $sec^{-1}$ in many instances.

The gloss of the moulded bottles obtained was measured using the procedure of ASTM D-2457, with separate measurements being made on at least two samples taken from each of at least three bottles i.e. at least six measurements being made on the inside and on the outside surfaces of each type of moulded bottle.

Further details and the results obtained are given in Table I.

TABLE I

| Run No. | Density | Melt Index | Stress Exponent | Process Aid | Gloss Inside | Outside |
|---|---|---|---|---|---|---|
| 1 | 0.956 | 1.00 | 1.30 | 400 | 37 | 70 |
| 2 | 0.956 | 1.00 | 1.35 | 800 | 30 | 74 |
| 3 | 0.956 | 1.00 | 1.35 | 1000 | 32 | 73 |
| 4 | 0.956 | 1.00 | 1.35 | 1200 | 31 | 73 |
| 5 | 0.956 | 1.00 | 1.35 | 1800 | 47 | 52 |
| 6 | 0.956 | 1.00 | 1.35 | 2000 | 51 | 51 |
| 7 | 0.956** | 1.00* | 1.35* | 800 | 77 | 77 |
| 8 | 0.955 | 0.43 | 1.91 | 0 | 9 | 9 |
| 9 | 0.955 | 0.43 | 1.91 | 800 | 11 | 12 |
| 10 | 0.945* | 0.64* | 1.56* | 400 | 27 | 25 |
| 11 | 0.937* | 0.59* | 1.62* | 235 | 15 | 24 |
| 12 | 0.937* | 0.91* | 1.63* | 0 | 34 | 29 |
| 13 | 0.937* | 0.91* | 1.63* | 800 | 34 | 29 |
| 14 | 0.937* | 0.35* | 1.74* | 80 | 14 | 15 |
| 15 | 0.935 | 0.28 | 1.78 | 0 | 11 | 13 |
| 16 | 0.935 | 0.28 | 1.78 | 800 | 30 | 40 |

TABLE I-continued

| Run No. | Density | Melt Index | Stress Exponent | Process Aid | Gloss Inside | Outside |
|---|---|---|---|---|---|---|
| 17 | 0.933 | 0.75 | 1.32 | 400 | 62 | 73 |
| 18 | 0.933 | 0.75 | 1.32 | 1200 | 60 | 67 |
| 19 | 0.923* | 1.30* | 1.41* | 0 | 63 | 80 |
| 20 | 0.920 | 1.40 | 1.35 | 0 | 38 | 73 |
| 21 | 0.920 | 1.40 | 1.35 | 800 | 61 | 80 |
| 22 | 0.919 | 0.75 | 1.33 | 470 | 11 | 27 |

*value calculated for blend i.e. not measured
**contained 4% by weight of a pigment
Note:
(a) Only the first five runs illustrate the invention, all other runs being comparative runs;
(b) Polymers were formed by polymerization or by blending together of two polymers, with the polymers of Runs 7, 10–14 and 19 being blends. All polymers being copolymers of ethylene and butene-1;
(c) Density in g/cm$^3$;
(d) Melt index in dg/min;
(e) Stress exponent is a ratio;
(f) Amount of Process aid in ppm;

The results show that bottles with a high outside or external gloss may be obtained by blow moulding of high density polyethylene, with the results obtained with such polymers being comparable with results obtained with low density polyethylene. However, the high gloss values with high density polyethylene were only obtained with polymers with narrow molecular weight distributions i.e. low values of stress exponent, whereas with low density polyethylene high gloss values were obtained with both narrow and broad molecular weight distributions i.e. high and low values of stress exponent.

EXAMPLE II

The procedure of Example I was repeated using a non-polished mould having a SPI-SPE gloss value of at least 5.

The results obtained are given in Table II. All results are of comparative runs.

TABLE II

| Run No. | Density | Melt Index | Stress Exponent | Process Aid | Gloss Inside | Outside |
|---|---|---|---|---|---|---|
| 23 | 0.956 | 1.00 | 1.30 | 400 | 48 | 25 |
| 24 | 0.956 | 1.00 | 1.35 | 800 | 37 | 27 |
| 25 | 0.956 | 1.00 | 1.35 | 1200 | 37 | 28 |
| 26 | 0.955 | 0.43 | 1.91 | 0 | 6 | 6 |
| 27 | 0.933 | 0.75 | 1.32 | 400 | 10 | 19 |
| 28 | 0.933 | 0.75 | 1.32 | 1200 | 26 | 21 |
| 29 | 0.920 | 1.40 | 1.35 | 0 | 25 | 31 |
| 30 | 0.920 | 1.40 | 1.35 | 800 | 26 | 36 |

The results show that with the mould with low surface gloss, bottles with low surface gloss were obtained. In the previous example, using a mould with high gloss, the polymers meeting the definition set forth herein for the invention gave bottles with significantly higher gloss values.

We claim:

1. A monolayer blow molded bottle having a glossy external surface, said monolayer bottle consisting essentially of a polymer selected from linear polyethylene having a density of at least 0.940 g/cm$^3$, a melt index of less than 2.0 dg/min, a stress exponent of less than 1.5, and containing at least 400 ppm of a fluoropolymer processing aid, said monolayer bottle having a gloss of at least 50 on its external surface.

2. The bottle of claim 1 in which the polymer is linear low pressure polyethylene.

3. The bottle of claim 2 in which the external surface thereof has a gloss of at least 60.

4. The bottle of claim 2 in which the external surface thereof has a gloss of at least 70.

* * * * *